US005131513A

United States Patent [19]

Gossage

[11] Patent Number: 5,131,513

[45] Date of Patent: Jul. 21, 1992

[54] DOCUMENT CARRIER

[76] Inventor: Carolyn M. Gossage, 615 Mt. Pleasant Rd., Suite 265, Toronto, Ontario, Canada

[21] Appl. No.: 525,755

[22] Filed: May 18, 1990

[51] Int. Cl.[5] ..... A45C 11/26; A45C 13/10

[52] U.S. Cl. ..... 190/107; 190/900; 190/903; 383/2

[58] Field of Search ..... 190/1, 107, 900, 903; 383/4, 2

[56] References Cited

U.S. PATENT DOCUMENTS

| | | | |
|---|---|---|---|
| 584,870 | 6/1897 | Giugliano | 190/107 X |
| 2,053,695 | 9/1936 | Buxton | 190/900 X |
| 2,667,353 | 1/1954 | Lanice | 383/4 X |
| 2,769,475 | 11/1956 | Fisher | 190/900 X |
| 3,830,348 | 8/1974 | Ohyama | 190/107 |
| 4,085,873 | 4/1978 | Schweitzer | 383/4 X |
| 4,180,114 | 12/1979 | Katz | 383/4 X |
| 4,604,765 | 8/1986 | Schultz | 383/4 X |

FOREIGN PATENT DOCUMENTS

| | | | |
|---|---|---|---|
| 1567623 | 5/1969 | France | 190/900 |
| 2582201 | 11/1986 | France | 190/900 |
| 1572922 | 8/1980 | United Kingdom | 190/107 |

*Primary Examiner*—Sue A. Weaver
*Attorney, Agent, or Firm*—Wyatt, Gerber, Burke and Badie

[57] ABSTRACT

There is provided a carrier, primarily for use with oversize documents. The carrier is of flexible construction, made of a flexible waterproof material such as canvas, nylon or the like, so that the carrier and its contents can be rolled as a unit, and held in rolled position by a fastener such as a pair of string ties, for ease of handling and transportation. When empty, the case can be folded into an integral pocket, to provide a small bulk for ease of storage.

7 Claims, 2 Drawing Sheets

DOCUMENT CARRIER

FIELD OF THE INVENTION

The present invention relates to flexible document carriers. More particularly, it relates to flat, flexible carriers particularly suited for carrying oversize, flat flexible items such as documents, posters, cardboards, canvases, unmounted pictures and the like.

BACKGROUND OF THE INVENTION AND PRIOR ART

There is a need in the marketplace for an inexpensive, conveniently transportable document carrier for protecting and carrying inexpensive but oversized documents. Whilst document carriers exist which are eminently suitable for carrying oversize documents and semi rigid items which are relatively high value, such as fine photographs, works of art, architectural drawings and the like, such existing items tend to be relatively expensive, consistent with the value of the documents they are intended to carry. Many of them are intended to maintain their contents in a flat condition. Those which receive the contents in a rolled condition, tend to be tubular and rigid.

Flexible garment bags, in which the garments are initially received in a flat condition but are then folded or rolled along with the bag, are also well known. However, these again are relatively expensive, and are sized and designed specifically to accommodate items of clothing.

At the bottom end of the market, however, there is a need for an inexpensive but reusable document carrier, e.g. for the transportation of children's art and school work. It is very common for a young child to be given a school project involving the preparation of an oversized picture or poster, e.g. on bristol board, which after completion, is to be taken home by the child. It would clearly be desirable for the child to be able to pack the document in a carrier which would protect it from the outdoor elements and other minor physical damage, so that the child can present the document at home in an undamaged, unspoiled condition. Any such carrier, to be successful, however, should be capable of easy filling and emptying, easy transportation and easy storage when not in use, to maximize the child's use of it. Further, any such item must be inexpensive.

SUMMARY OF THE INVENTION

It is an object of the present invention to provide a novel flexible carrier for easy transportation of documents and the like, in a rolled, weather protected condition.

In accordance with the present invention, there is provided a flexible document carrier having side panels and a closeable opening, defining a pocket of appropriate size to receive therein an oversized document. Carrying handles are provided, protruding from the top of the carrier. The carrier can be rolled up, from side to side, with a document therein, to leave the carrying handles still protruding from the top of the carrier in its rolled up position. Fastening means are provided to secure the carrier in its rolled up position, for ease of transportation.

Thus the present invention provides a flexible, rollable carrier for carrying and protecting flat rollable items, said carrier comprising:

a pair of interconnected flexible, generally rectangular or square side panels defining therebetween a flat pocket for reception of a flat rollable item therein, and having a bottom edge, first and second side edges and a top edge;

at least one of said bottom edge, side edges and top edge having a closable opening providing access said pocket for insertion and withdrawal of items to and from the pocket;

at least one carrying handle protruding beyond the top edge;

a releasable fastening means adjacent said first side edge;

the carrier being rollable from a flat, item-inserting position to a rolled-up position in which said second side edge is disposed interiorly of the so-formed roll, and in which said carrying handle protrudes beyond the top of the roll;

said side panels being constructed of substantially waterproof flexible material.

BRIEF REFERENCE TO THE DRAWINGS

FIG. 1 of the accompanying drawings is a diagrammatic perspective view of the specific preferred embodiment of the invention, in its flat disposition;

DESCRIPTION OF THE PREFERRED EMBODIMENTS

Figure 1:
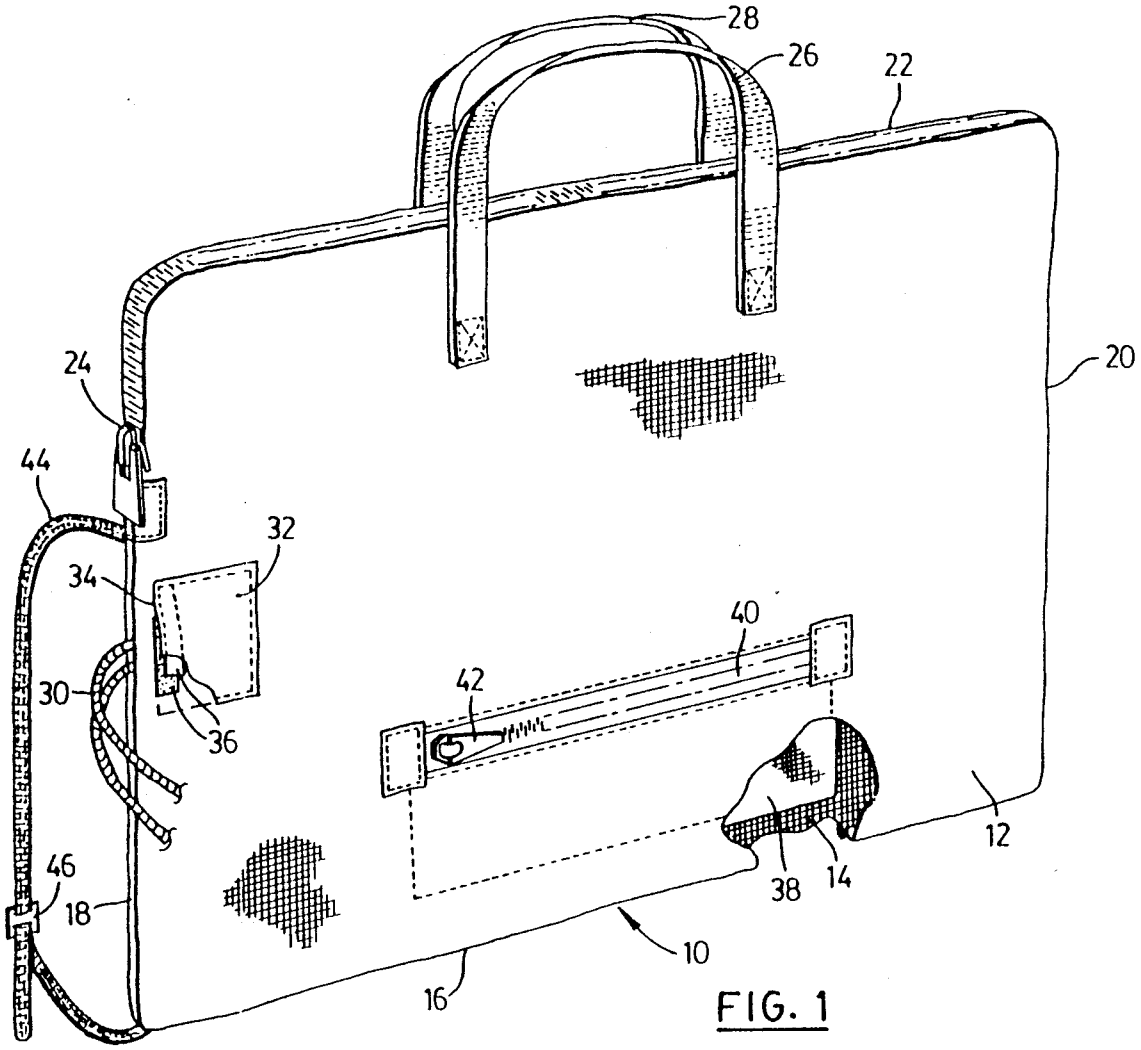

Preferably, the document carrier of the present invention is rectangular in shape, with the closeable opening being provided in the top wall. Suitably, the closeable opening is equipped with a zip closure, but other forms of closure can be used, consistent with maintaining the waterproof nature of the inner pocket, and the rollability of the carrier.

The releasable fastening means adjacent the first side edge of the carrier can be any of a variety of fasteners, adapted to hold the carrier releasably in its rolled position. Combinations of press studs, hooks and eyes, hook and pile fasteners and the like can be used. Preferred, however, is a simple pair of string ties, fastened to the side panels near the first edge, which are simply tied together when the rolling up of the carrier has been completed. This obviates the need for arranging for coincidence of cooperative elements by appropriately adjusting the tightness of the roll, a significant advantage where a child is operating the carrier.

It is also preferred to provide a storage pocket for the string ties, when not in use. This is suitably arranged in the form of an integral flat small closable pocket, adjacent the first side edge of the panels, with its opening disposed towards the edge, and equipped with a snap fastener or velcro fastener.

By arranging to have the carrying handles protrude beyond the top edge of the carrier, these can be left outside the body of the carrier when it is rolled up. Then they will protrude from the top of the roll, for use as transportation handles when the carrier is in its rolled-up position, as well as when the carrier is in its flat position.

It is also preferred to provide a flexible storage pocket on one of the side panels of the carrier, into which the bulk of the carrier can be inserted in a rolled and folded condition for storage purposes. Conveniently, this storage pocket is provided near the bottom edge of a side panel, and can be disposed within the main, document receiving pocket when the carrier is in use, but can be turned inside out and extracted therefrom, to be disposed exteriorly of the side panel, when the document carrier is not in use. Then the bulk of the carrier can be folded and rolled and inserted into this pocket in its exterior position, for storage purposes. Conveniently, this storage pocket is provided with a closure means such as a zip, to keep the document carrier in a suitable, compact position for storage and transportation, when not in use for its intended purpose.

The carrier is suitably made of cheap, flexible, waterproof material such as nylon, polyethylene or other suitable plastics materials, canvas, waterproof fabrics and the like. Since it finds its primary application in use by children, the materials of construction should be relatively cheap, and the nature of the construction should be simple and straightforward to manufacture, so that the item can be retailed at an attractive price for the family budget.

DETAILED DESCRIPTION OF THE SPECIFIC PREFERRED EMBODIMENT

With reference to FIG. 1 of the accompanying drawings, the carrier 10 according to the invention is of generally rectangular shape comprising a first side panel 12 and a second side panel 14 with a closed bottom edge 16, a substantially closed first side edge 18, a substantially closed second side edge 20 and an open top 22, closed by a zip fastener 24. The zip fastener 24 and its track extend a small distance down the first side wall 18 and the second side wall 20, so that, when the zip 24 is fully opened, easy access is provided to the interior pocket defined by the side panels 12, 14.

A pair of carrying handles 26, 28 are secured to the respective side panels and protrude upwardly beyond the top 22 of the carrier 10.

Adjacent the first side edge 18, there is provided a pair of string ties 30 secured to the side panels. A closable pocket 32 is provided on side panel 12, adjacent the first side edge 18, the opening 34 of the pocket 32 being presented towards the side edge 18. The string ties 30, when not in use, can be inserted into pocket 32, and then this pocket 32 can be releasably closed by means of cooperating VELCRO strips 36 provided on opening edge 34 of the pocket.

Near the bottom edge 16 of the carrier 10, there is provided a flexible storage pocket 38, attached to the inner face of the first side panel 12, an opening for access to storage pocket 38 being provided through side panel 12 at 40, closed by means of a zip fastener 42. When the opening 40 is opened, storage pocket 38 can be extracted and turned inside out to lie outside of first side panel 12.

A shoulder strap 44 is attached to the first side edge 18, including a length adjustment buckle 46, for alternative carrying by the user.

Figure 2:
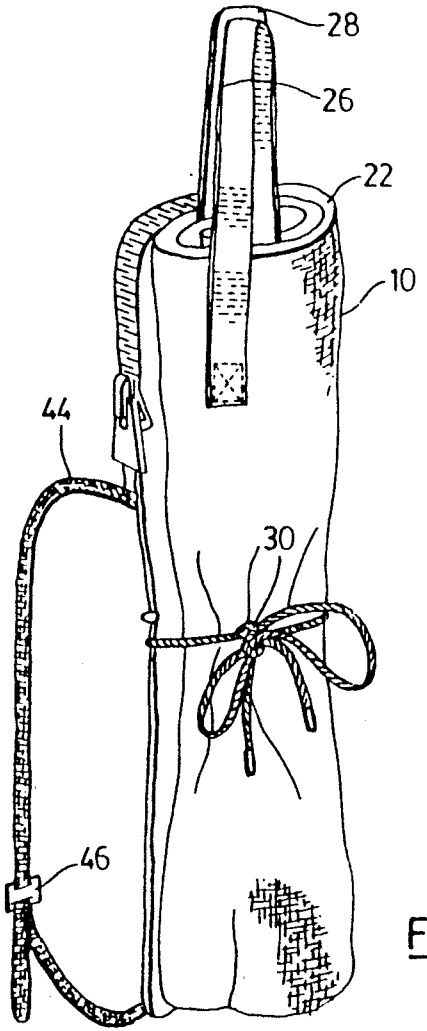
FIG. 2 is a diagrammatic perspective view of the same embodiment of the invention in its rolled-up position.

With reference to FIG. 2, the carrier 10 is now shown in its rolled up, transportation position. After insertion of a document into the pocket defined by panels 12, 14, the carrier 10 has been rolled up from side to side, starting from second side edge 20, and rolling towards first side edge 18. Carrying handles 26, 28 are maintained protruding above top 22 of the carrier 10 during the rolling exercise, so that they remain protruding above the top edge and useful as carrying handles when the carrier 10 has assumed its rolled up position. String ties 30 are appropriately tied together, so as to secure the carrier in its rolled up position.

Figure 3:
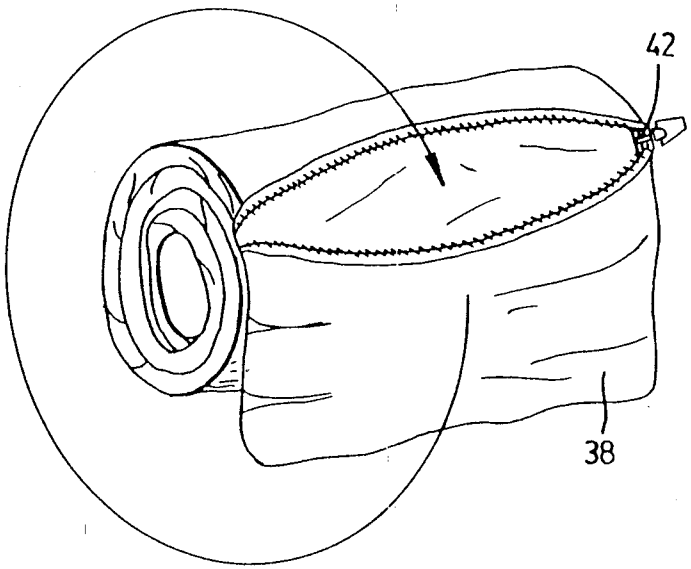
FIG. 3 illustrates the embodiment of the invention being put into storage mode, using its integral storage pocket.

With reference to FIG. 3, the carrier 10 is now shown in a position in which the side panels have been folded inwardly and rearwardly from the position shown in FIG. 1, and rolled downwardly from the top 22 towards the opening 40. The storage pocket 38 is disposed exteriorly of the carrier 10, with its zip closure 42 in the open position. Now the remainder of the carrier can be bundled into storage pocket 38, and the zipper thereof closed to close opening 40, for ready storage of the carrier 10 when not in use. Indeed, when the item is made of the preferred material, nylon, it can be folded and stored into storage pocket 38 in such a compact condition that it can be carried in the pants pocket of a child user.

It will be clear from the above description, that the document carrier according to the invention can be made in substantially any convenient size. A particularly preferred size is that to accommodate comfortably the standard sheet of bristol board, the dimensions of which are approximately 22"×28", a commonly used item for children's school projects. Thus, the most suitable size range for the carrier of the present invention is from about 18"–30" in depth and 24"–48" in width. The item is simple and easy to manufacture, can be made of strong, light weight material such as nylon, to provide an article of economical cost, repeatedly reusable for the transportation of such oversized documents.

Whilst a specific preferred embodiment of the invention has been described and illustrated in detail, it is to be understood that this is for illustrative purposes only, and the invention is not to be construed to be limited to these precise features of construction. The scope of the invention is defined only by the appended claims when fairly construed.

I claim:

1. A flexible rollable carrier for carrying and protecting flat rollable items, said carrier comprising:

a pair of interconnected flexible, generally rectangular side panels defining therebetween a flat pocket for reception of a flat rollable item therein, and having a bottom edge, first and second side edges and a top edge;

said top edge having a closable opening equipped with a zipper closure and providing access to said pocket for insertion and withdrawal of items to and from the pocket;

at least one carrying handle protruding beyond the top edge;

a releasable fastening means adjacent said first side edge;

and a flexible storage pocket having means for attachment to one side panel and having a top access opening thereto, said storage pocket being disposable inside the pocket between the panels, and outside the pocket between the panels, the storage pocket in its outside disposition being dimensioned to receive the remainder of the carrier in a bundled condition, for storage purposes;

the carrier being rollable from a flat, item-inserted position to a rolled up position in which said second side edge is disposed interiorly of the so formed roll, and in which said carrying handle protrudes beyond the top of the roll;

said side panels being constructed of substantially waterproof flexible material.

2. The carrier of claim 1 wherein the releasable fastening means comprises a pair of string ties.

3. The carrier of claim 2 further including a closable pocket on the outer surface of one side panel, adjacent to said first side edge, for reception of said string ties when not in use.

4. The carrier of claim 1 wherein the storage pocket is provided with releasable top closure.

5. The carrier of claim 4 wherein the storage pocket is disposed near the bottom edge of the side panel.

6. The carrier of claim 4 further including a shoulder strap secured to said first side edge.

7. A flexible, rollable carrier for carrying and protecting flat rollable items, said carrier being of generally rectangular shape and comprising:

a pair of interconnected flexible, generally rectangular side panels defining therebetween a flat pocket for reception of a flat rollable item therein, and having a bottom edge, first and second side edges and a top edge;

said top edge having a closable opening equipped with a zipper closure and providing access to said pocket for insertion and withdrawal of items to and from the pocket;

at least one carrying handle protruding beyond the top edge;

a releasable fastening means in the form of a pair of string ties adjacent to said first side edge;

and a closable pocket on the outer surface of one side panel, adjacent to said first side edge, for reception of said string ties when not in use;

the carrier being rollable from a flat, item-inserted position to a rolled-up position in which said second side edge is disposed interiorly of the so-formed roll, and in which said carrying handle protrudes beyond the top of the roll;

said side panels being constructed of substantially water-proof flexible material.

* * * * *